United States Patent [19]

Matthews

[11] 4,379,214

[45] Apr. 5, 1983

[54] TRIGGER OPERATED TOOL HANDLE SWITCH

[75] Inventor: Benjamin H. Matthews, Peninsula, Ohio

[73] Assignee: Lucerne Products, Inc., Hudson, Ohio

[21] Appl. No.: 334,827

[22] Filed: Dec. 28, 1981

[51] Int. Cl.[3] ..... H01H 13/08

[52] U.S. Cl. ..... 200/157; 200/241; 200/260

[58] Field of Search ..... 200/157, 275, 239, 241, 200/243 (U.S. only), 252, 254–257, 260

[56] References Cited

U.S. PATENT DOCUMENTS

| | | | |
|---|---|---|---|
| 3,415,966 | 12/1968 | Matthews | 200/157 |
| 3,594,523 | 7/1971 | Frenzel | 200/157 |
| 3,603,757 | 9/1971 | Sahrbacker | 200/157 |
| 4,137,438 | 1/1979 | Sato et al. | 200/252 |
| 4,210,791 | 7/1980 | Sorenson | 200/260 |
| 4,256,942 | 3/1981 | Wied | 200/157 |
| 4,329,555 | 5/1982 | Wied | 200/157 |

FOREIGN PATENT DOCUMENTS

| | | | |
|---|---|---|---|
| 674504 | 11/1963 | Canada | 200/257 |

*Primary Examiner*—John W. Shepperd
*Assistant Examiner*—Renee Kidorf
*Attorney, Agent, or Firm*—Baldwin, Egan, Walling & Fetzer

[57] ABSTRACT

An electric switch mechanism for portable electric motor drive type tools having a reciprocable contact carrier and a movable electrically conductive bridging contact carried by the contact carrier for making and breaking electrical contact with coacting stationary contacts in the switch mechanism. The bridging contact has a protuberance at each point of contact with the contact carrier to ensure that such contact therebetween at each such point is always at the same spot(s) on the bridging contact when the bridging contact is reciprocated by the contact carrier in either direction.

4 Claims, 5 Drawing Figures

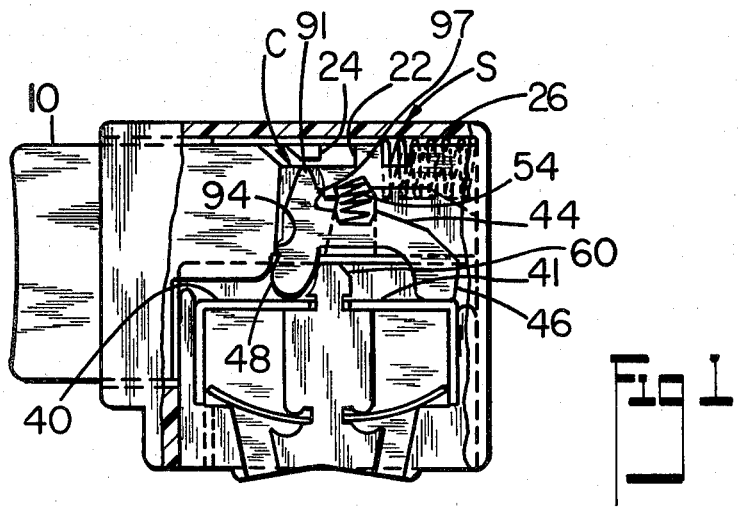
Fig 1
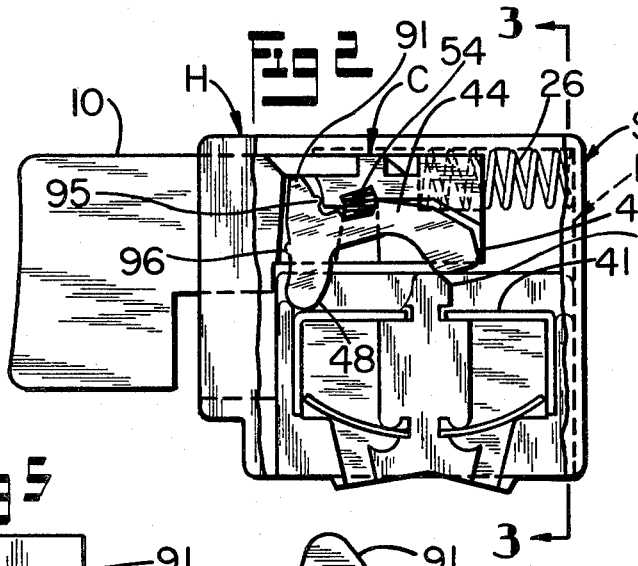
Fig 2
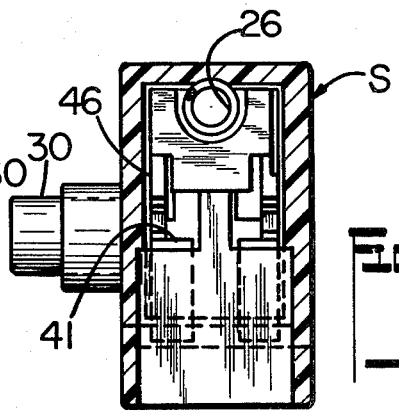
Fig 3
Fig 5
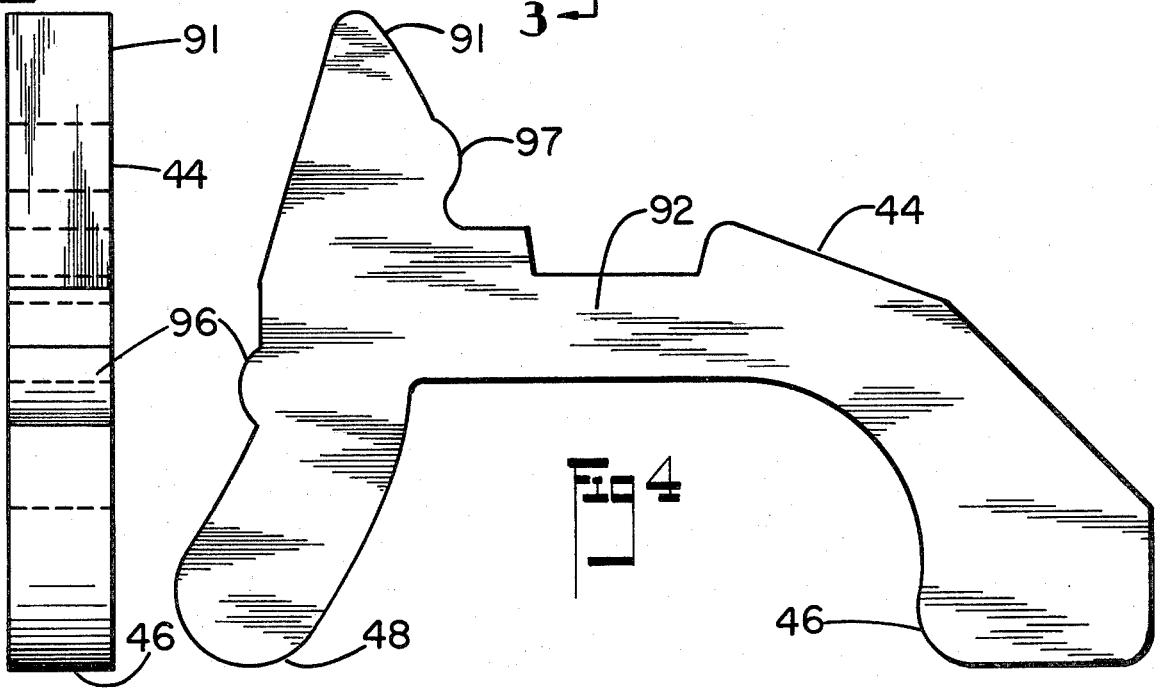
Fig 4

TRIGGER OPERATED TOOL HANDLE SWITCH

DESCRIPTION

Technical Field

This invention relates to an electrical switch of the type used in portable electric motor drive type tools, and more particularly to such a switch having a reciprocable contact carrier and a movable electrically conductive bridging contact carried by the contact carrier for making and breaking electrical contact with coacting stationary contacts in the switch mechanism.

Background of the Invention

The present invention is directed to improvements in trigger operated electric switches of the type wherein a bridging contact is slid by a reciprocable contact carrier between bridging and non-bridging positions with respect to a pair of fixed contacts mounted in spaced relation on a dielectric base. The bridging contact includes a pair of spaced contact faces arranged for simultaneous engagement with respective fixed contacts thereby to define the bridging position of the bridging contact. One of these contact faces may slide along the associated fixed contact and remain in engagement with the same at all times. When the other of these contact faces engages the other fixed contact, the switch is closed for closing the associated circuit and energizing a load device, such as an electric motor. It is desirable that this other contact face be maintained in substantial spaced relation from the other fixed contact to define the open or "off" position of the switch. When it is desired to close the switch and circuit, such other contact face is brought into engagement with the other fixed contact in a quick and positive manner to effect a "quick make" action, and this same quick and positive action is also desirable upon opening of the switch to effect a "quick break" action, such "actions" being essential to forestall premature pitting and corrosion of the contact surfaces.

In certain prior art structures, the bridging contact is reciprocally carried by the contact carrier and a projection is disposed between the stationary contacts for engagement with the leading contact end for pivoting and lifting the leading contact end from its stationary contact in coaction with the hinged connection with a "quick break" action during movement of the contact carrier to the non-bridging position. The "quick make" action is also effected in such structure.

In such prior switches the "quick break" and "quick make" actions are often diminished because the contact carrier (on the forward and return stroke) does not always contact the bridging contact at the same (two) point(s) of contact on the bridging contact. More specifically, most bridging contacts have broadly curved contours at their two points of contact with the contact carrier, with the result tht the contact carrier may hit or contact such broad curved contours at a different point(s) on the forward and return strokes with the result that the "quick break" and "quick make" actions become erratic.

Therefore, it is an object of the invention to provide a trigger operated hand tool switch having a bridging contact movable with respect to a pair of fixed contacts, wherein one end of the bridging contact is consistently moved into and out of engagement with one of the fixed contacts in a fast and highly effective manner to effect consistent "quick make" and "quick break" action therewith.

A further object of the invention is to provide an electric switch of the above type wherein the bridging contact has a protuberance at each point of contact with the contact carrier to ensure that such contact therebetween at each such point is always at the same spot(s) on the bridging contact when the bridging contact is reciprocated by the contact carrier in either direction to effect positive and consistent "quick make" and "quick break" action therebetween.

A further object of the invention is to provide a trigger operated switch of the above type that is simple in construction, inexpensive to manufacture, and highly effective in operation.

Summary of the Invention

Briefly, the foregoing objects are accomplished by the provision of an electric switch mechanism for portable electric motor drive type tools including an insulator switch housing with at least a pair of stationary electrical contacts disposed in the switch housing in spaced relation to each other and with their contact making faces substantially coplanar. A reciprocable contact carrier is disposed in the housing for linear reciprocation therein relative to said stationary contacts. A movable electrically conductive bridging contact is carried by the contact carrier and has opposite contacting ends forming respectively a leading contact end and a trailing contact end spaced at approximately the same spacing as the stationary contacts for sliding movement between a non-bridging position where the bridging contact is out of engagement with at least one of said stationary contacts and a bridging position where the bridging contact is in engagement with at least two of the stationary contacts in electrically conducting relation therewith. Bias means is provided in the contact carrier in the form of a compressed coil spring urging the movable bridging contact towards the stationary contacts. A projection is disposed between the stationary contacts for engagement with the leading contact end and is configured for pivoting and lifting the leading contact end off of the adjacent respective stationary contact with a quick break action during reciprocable movement of the contact carrier to a level substantially above the contact making face of the adjacent respective stationary contact.

In one form of the invention, the projection between the spaced stationary contacts is approximately one-eighth of an inch in height to provide sufficient arc-breaking distance for the voltage encountered in hand tool use.

The bridging contact has a protuberance at each point of contact with the contact carrier to ensure that such contact therebetween at each such point is always at the same spot(s) on the bridging contact when the bridging contact is reciprocated by the contact carrier in either direction. Also, such protuberances ensure rotatable contact at one point (i.e. the protuberance) such that the bridging contact has rotatable motion during the "quick make" and "quick break" actions for optimum operation of the switch. Additionally, the protuberances also function as wear points.

Other objects and advantages of the invention will be apparent from the following description taken in conjunction with the drawings wherein:

BRIEF DESCRIPTION OF THE DRAWINGS

FIG. 1 is a front elevational partially sectional view of a portion of a trigger operated tool handle switch embodying the present invention and showing the switch in its "bridging" or "on" position;

FIG. 2 is a view similar to FIG. 1, but showing the switch in its "non-bridging" or "off" position;

FIG. 3 is a view taken along the line 3—3 of FIG. 2;

FIG. 4 is an enlarged front elevational view of the bridging contact shown in FIGS. 1 and 2; and FIG. 5 is a left side view of FIG. 4.

In the drawings like numbers and letters are used to identify like and similar parts through the several views.

The present invention is directed to improvements in electric switches of the type shown in copending application Ser. No. 117,866, filed Feb. 4, 1980, now U.S. Pat. No. 4,329,555, the switch mechanism portion of assignee's U.S. Pat. No. 3,603,757, issued Sept. 7, 1971, reissue patent RE. 26,267 issued on Sept. 26, 1967 and its parent U.S. Pat. No. 3,222,488 issued on Dec. 7, 1965, such present invention now being described in an embodiment of a switch which makes and breaks the contacts in both sides of an energizing electrical source, although those skilled in this art will understand that one side only of the like might incorporate the switch while the other line was unbroken.

Referring first to FIGS. 1–3, there is shown an electric switch mechanism for portable electric hand tools, generally designated as S, which includes as basic components the wrap-around switch housing H (FIG. 2) which encases and holds the switch module or casing M that is operated by the bridging contact carrier C having a trigger handle 10. Casing M may be readily formed from electrical insulating material such as plastic or the like.

The contact carrier C is reciprocably retained in the housing H by the interlocking action of the contact carrier tab 22 (FIG. 1), engaging the switch housing rib 24 in coaction with the compressed coil contact carrier spring 26, which biases the contact carrier to a leftward "off" position as shown in FIG. 2.

A suitable spring pushbutton plunger 30 is provided to coact with the trigger 10 and lock the contact carrier C in its full "on" position as is well known in the art. The spring pressed plunger mechanism 30 will not be described in more detail as the same forms no part of the present invention and is fully described in assignee's U.S. Pat. No. 3,536,973, issued Oct. 27, 1970.

The insulator switch housing H contains the switch module portion M which has at least a pair of spaced stationary electrical contacts 40 and 41 having their contact making faces coplanar. The contact carrier C is disposed in the housing H for linear reciprocation relative to the stationary contacts as described in the aforementioned U.S. Pat. No. 3,603,757. The contact carrier is normally disposed in a leftward "off" position, as shown in FIG. 2, by the biasing action of the compressed contact carrier coil spring 26 which is disposed between the contact carrier and the opposite wall of the housing H as aforedescribed.

The contact carrier C carries with it, in its reciprocable movement, an electrically conductive bridging contact 44 which has opposite coacting ends forming, respectively, a leading contact end 46, and a trailing contact end 48, spaced approximately at the same spacing as the stationary contacts 40 and 41, for sliding movement between a non-bridging position (FIG. 2), where the bridging contact leading end 46 is out of engagement with the stationary contact 41 and a bridging position (FIG. 1), where the bridging contact leading edge 46 is in engagement with the stationary contact 41 in electrically conducting relation therewith. The trailing end 48 is always in contact with the stationary contact 40.

The bridging contact is biased towards the stationary contacts 40 and 41 by suitable bias means in the form of the compressed coil spring 54 disposed between the bridging contact 44 and the contact carrier C as shown.

A projection 60 is disposed between the stationary contacts 40 and 41 for engagement with the contact carrier leading contact end 46, and is configured for pivoting and lifting the leading contact end off of the adjacent respective stationary contact 41 with a "quick break" action during movement of the bridging contact leading contact end 46 to a level substantially above the contact making face of the adjacent respective stationary contact 41.

In one form of the invention, the projection 60 is approximately one-eighth of an inch in height above the plane of the contact making faces of the stationary contacts 40 and 41 to provide, in coaction with the aforedescribed "quick break" action, a quick and positive clean-break of any electrical arc that may develop between the leading end 46 and the stationary contact 41 from the voltages (110 or 220 volts) normally encountered in electric hand tool use.

The bridging contact 44 has an upwardly extending stem 91 formed in its top surface at its trailing contact end, by means of which the bridging contact is carried or reciprocated by the contact carrier C in one direction. Thus, there is provided a movable electrically conductive bridging contact 44 carried by the contact carrier C and including a horizontally elongated body portion 92 having opposite downwardly extending contacting end portions forming respectively a forward contact end portion 46 and rearward contact end portion 48 spaced at approximately the same spacing as the stationary contacts 40, 41, for sliding movement between a non-bridging position (FIG. 2) where the bridging contact 44 is out of engagement with at least one of the stationary contacts (i.e. the contact 41) and a bridging position where the bridging contact is in engagement with the two stationary contacts 40, 41, in electrically conducting relation therewith. The contact carrier elongated body portion 92 also has the aforementioned upwardly extending stem 91 for reciprocable contact with the contact carrier in one direction, as will now be explained.

Referring to FIGS. 1, 2 and 4, the bridging contact 44 is pushed or reciprocated back and forth by the contact barrier C. More specifically, the bridging contact 44 is contacted by the contact carrier C at the point 94 (FIG. 1) on the contact carrier when the bridging contact is pushed to the right to its bridging position. On the return or leftward stroke, the bridging contact is contacted by the contact carrier at the point 95 (FIG. 2) on the contact carrier.

The bridging contact 44 has a protuberance 96 (FIGS. 2 and 4) opposite the point 94 on the contact carrier. Also, the bridging contact has a protuberance 97 (FIGS. 1 and 4) opposite the point 95 on the contact carrier. The protuberances 96 and 97 function as wear points on the bridging contact and assure the same point of contact on the bridging contact when it is reciprocated. Also, such protuberances 96 and 97 effect a rotatable contact at one point on the bridging contact when reciprocated.

Thus, the invention provides a bridging contact having a protuberance at each point of contact with the contact carrier to ensure that such contact therebetween at each such point is always at the same spot(s) on the bridging contact when the bridging contact is reciprocated by the contact carrier in either direction. As aforementioned, the bridging contact includes a horizontally elongated body portion 92 having a downwardly and rearwardly extending trailing contact end portion 48 having one of the protuberances (96) on its rearward edge, and the body portion 92 has an upwardly extending stem 91 having another of the protuberances (97) on its forward edge.

The invention also contemplates a bridging contact of the type reciprocated by a contact carrier in an electric switch mechanism for portable electric motor drive type tools, the bridging contact having a protuberance at each point of contact with the contact carrier to ensure that all such contacts therebetween are at the same points on the bridging contact when the bridging contact is reciprocated by the contact carrier in either direction.

In summary, the invention provides an electric switch mechanism S for portable electric motor drive type tools including, an insulator switch housing H, at least a pair of stationary electrical contacts 40, 41, disposed in the switch housing H in spaced relation to each other and with their contact making faces substantially coplanar. A reciprocable contact carrier C is disposed in the housing H for linear reciprocation therein relative to the stationary contacts 40, 41. A movable electrically conductive bridging contact 44 is carried by the contact carrier C and includes a horizontally elongated body portion 92 having opposite downwardly extending contacting end portions forming respectively a forward contact end portion 46 and rearward contact end portion 48 spaced at approximately the same spacing as the stationary contacts 40, 41, for sliding movement between a non-bridging position (FIG. 2) where the bridging contact 44 is out of engagement with at least one of the stationary contacts and a bridging position (FIG. 1) where the bridging contact is in engagement with the stationary contacts 40, 41, in electrically conducting relation therewith. The contact carrier elongated body portion 92 also has an upwardly extending stem 91 for reciprocable contact with the contact carrier in one direction. Bias means 54 is provided on the contact carrier to urge the movable bridging contact 44 towards the stationary contacts 40, 41, and a projection 60 is disposed between the stationary contacts 40, 41, for engagement with the foreward contact end portion 46 and configured for pivoting and lifting the forward contact end portion 46 off of the adjacent respective stationary contact 41 with a quick break action during movement of the bridging contact leading contact end portion 46 to a level substantially above the contact making face of the adjacent respective stationary contact 41. The bridging contact stem 91 has a protuberance 97 on its forward edge for contact with the contact carrier C at the point 95 to ensure that such contact therebetween is always at the same point on the bridging contact when the bridging contact is reciprocated by the contact carrier up and over the projection 60. The bridging contact rearward contact end portion 48 has a protuberance 96 on its rearward edge for contact with the contact carrier C at the point 94 to ensure that such contact therebetween is always at the same such point on the rearward contact end portion 48 when the bridging contact 44 is reciprocated by the contact carrier C.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

I claim:

1. In an electric switch mechanism for portable electric motor drive type tools having a reciprocable contact carrier and a movable electrically conductive bridging contact carried by the contact carrier for making and breaking electrical contact with coacting stationary contacts in the switch mechanism, the improvement comprising; said bridging contact having a protuberance at each point of contact with the contact carrier to ensure that such contact therebetween at each such point is always at the same spot(s) on the bridging contact when the bridging contact is reciprocated by the contact carrier in either direction, said bridging contact including a horizontally elongated body portion having a downwardly and rearwardly extending trailing contact end portion having one of said protuberances on its rearward edge, and said body portion having an upwardly extending stem having another of said protuberances on its forward edge.

2. An electric switch mechanism for portable electric motor drive type tools comprising, an insulator switch housing, at least a pair of stationary electrical contacts disposed in said switch housing in spaced relation to each other and with their contact making faces substantially coplanar, a reciprocable contact carrier disposed in the housing for linear reciprocation therein relative to said stationary contacts, a movable electrically conductive bridging contact carried by said contact carrier and having opposite contacting ends forming respectively a leading contact end and a trailing contact end spaced at approximately the same spacing as said stationary contacts for sliding movement between a non-bridging position where said bridging contact is out of engagement with at least one of said stationary contacts and a bridging position where the bridging contact is in engagement with at least two of said stationary contacts in electrically conducting relation therewith, and bias means on the contact carrier urging the movable bridging contact towards the stationary contacts, said bridging contact having a protuberance at each point of contact with said contact carrier to ensure that all such contacts therebetween are at the same points on the bridging contact when the bridging contact is reciprocated by the contact carrier in either direction.

3. An electric switch mechanism for portable electric motor drive type tools comprising, an insulator switch housing, at least a pair of stationary electrical contacts disposed in said switch housing in spaced relation to each other and with their contact making faces substantially coplanar, a reciprocable contact carrier disposed in the housing for linear reciprocation therein relative to said stationary contacts, a movable electrically conductive bridging contact carried by said contact carrier and having opposite contacting ends forming respectively a leading contact end and a trailing contact end spaced at approximately the same spacing as said stationary contacts for sliding movement between a non-bridging position where said bridging contact is out of engagement with at least one of said stationary contacts and a bridging position where the bridging contact is in engagement with at least two of said stationary contacts in electrically conducting relation therewith, bias means on the contact carrier urging the movable bridging contact towards the stationary contacts, and a projection disposed between said stationary contacts for engagement with said leading contact end and configured for pivoting and lifting the leading contact end off of the adjacent respective stationary contact with a quick break action during movement of the bridging contact leading contact end to a level substantially above the contact making face of the adjacent respective stationary contact, said bridging contact having a protuberance at each point of contact with said contact carrier to ensure that all such contacts therebetween are at the same points on the bridging contact when the bridging contact is reciprocated by the contact carrier up and over said projection in either direction.

4. An electric switch mechanism for portable electric motor drive type tools comprising, an insulator switch housing, at least a pair of stationary electrical contacts disposed in said switch housing in spaced relation to each other and with their contact making faces substantially coplanar, a reciprocable contact carrier disposed in the housing for linear reciprocation therein relative to said stationary contacts, a movable electrically conductive bridging contact carried by said contact carrier and including a horizontally elongated body portion having opposite downwardly extending contacting end portions forming respectively a forward contact end portion and rearward contact end portion spaced at approximately the same spacing as said stationary contacts for sliding movement between a non-bridging position where said bridging contact is out of engagement with at least one of said stationary contacts and a bridging position where the bridging contact is in engagement with at least two of said stationary contacts in electrically conducting relation therewith, said contact carrier elongated body portion also having an upwardly extending stem for reciprocable contact with the contact carrier in one direction, bias means on the contact carrier urging the movable bridging contact towards the stationary contacts, and a projection disposed between said stationary contacts for engagement with said forward contact end portion and configured for pivoting and lifting the forward contact end portion off of the adjacent respective stationary contact with a quick break action during movement of the bridging contact leading contact end portion to a level substantially above the contact making face of the adjacent respective stationary contact, said bridging contact stem having a protuberance on its forward edge for contact with said contact carrier to ensure that such contact therebetween is always at the same such point on the bridging contact when the bridging contact is reciprocated by the contact carrier up and over said projection, said bridging contact rearward contact end portion having a protuberance on its rearward edge for contact with said contact carrier to ensure that such contact therebetween is always at the same such point on the rearward contact end portion when the bridging contact is reciprocated by the contact carrier.

* * * * *